US011138954B2

(12) United States Patent
Park et al.

(10) Patent No.: US 11,138,954 B2
(45) Date of Patent: Oct. 5, 2021

(54) ELECTRONIC DEVICE FOR COMPENSATING FOR DETERIORATION IN DISPLAY

(71) Applicant: SAMSUNG ELECTRONICS CO., LTD., Suwon-si (KR)

(72) Inventors: Hyunjun Park, Suwon-si (KR); Dongkyoon Han, Suwon-si (KR); Jongkon Bae, Suwon-si (KR); Hongkook Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/962,413

(22) PCT Filed: Jan. 21, 2019

(86) PCT No.: PCT/KR2019/000829
§ 371 (c)(1),
(2) Date: Jul. 15, 2020

(87) PCT Pub. No.: WO2019/146975
PCT Pub. Date: Aug. 1, 2019

(65) Prior Publication Data

US 2021/0074240 A1 Mar. 11, 2021

(30) Foreign Application Priority Data

Jan. 24, 2018 (KR) ..... 10-2018-0008815

(51) Int. Cl.
*G09G 5/10* (2006.01)

(52) U.S. Cl.
CPC ..... *G09G 5/10* (2013.01); *G09G 2300/0452* (2013.01); *G09G 2320/0257* (2013.01); *G09G 2320/043* (2013.01)

(58) Field of Classification Search
CPC ..... G09G 5/10; G09G 2300/0452; G09G 2320/0257; G09G 2320/043;
(Continued)

(56) References Cited

U.S. PATENT DOCUMENTS 8,711,136 B2 4/2014 Park
9,001,165 B2 4/2015 Park et al.
(Continued)

FOREIGN PATENT DOCUMENTS

JP 2005-077824 3/2005
KR 10-2006-0120766 11/2006
(Continued)

OTHER PUBLICATIONS

International Search Report for PCT/KR2019/000829, dated May 10, 2019, 4 pages.
(Continued)

*Primary Examiner* — Rodney Amadiz
(74) *Attorney, Agent, or Firm* — Nixon & Vanderhye, P.C.

(57) ABSTRACT

An electronic device is provided. The electronic device may include a display panel on which at least one pixel is disposed, a converter for applying a first voltage to the pixel to enable the pixel to emit light, a gamma circuit including a resistor string in which a plurality of resistors are connected and applying a second voltage to the converter, a logic circuit for changing a point where the resistor string and the converter are connected, and a processor electrically connected to the logic circuit.

15 Claims, 7 Drawing Sheets

(58) Field of Classification Search
CPC ..... G09G 2320/0686; G09G 2330/028; G09G 2320/0673; G09G 3/20
See application file for complete search history.

(56) References Cited

U.S. PATENT DOCUMENTS

| | | | | |
|---|---|---|---|---|
| 9,265,125 | B2 | 2/2016 | Kim et al. | |
| 9,311,848 | B2 * | 4/2016 | Keum | G09G 3/3233 |
| 10,297,187 | B2 * | 5/2019 | Bang | G09G 3/2092 |
| 10,867,551 | B2 * | 12/2020 | Ok | G09G 3/3208 |
| 2013/0135272 | A1 | 5/2013 | Park | |

FOREIGN PATENT DOCUMENTS

| | | |
|---|---|---|
| KR | 10-2008-0111291 | 12/2008 |
| KR | 10-2013-0130482 | 12/2013 |
| KR | 10-2014-0040912 | 4/2014 |
| KR | 10-2017-0031277 | 3/2017 |
| KR | 10-2017-0131804 | 11/2017 |

OTHER PUBLICATIONS

Written Opinion of the ISA for PCT/KR2019/000829, dated May 10, 2019, 6 pages.
Extended European Search Report and Written Opinion dated Jun. 2, 2021 in corresponding European Patent Application No. 19744353.4.

* cited by examiner

ELECTRONIC DEVICE FOR COMPENSATING FOR DETERIORATION IN DISPLAY

This application is the U.S. national phase of International Application No. PCT/KR2019/000829 filed 21 Jan. 2019, which designated the U.S. and claims priority to KR Patent Application 10-2018-0008815 filed 24 Jan. 2018, the entire contents of each of which are hereby incorporated by reference.

TECHNICAL FIELD

Embodiments disclosed in the present disclosure relate to a technology for compensating for deterioration occurring in a display.

BACKGROUND ART

A display is able to output various images, pictures, and so on, by causing pixels included in the display to emit light. For example, one pixel may include a red sub-pixel, a green sub-pixel, and a blue sub-pixel. The display is able to output various images, pictures, and so on, by allowing the respective sub-pixels to emit light.

DISCLOSURE OF THE INVENTION

Technical Problem

Since the red sub-pixel, the green sub-pixel, and the blue sub-pixel have different structures from one another, the loads applied to the respective sub-pixels may be different. For example, the blue sub-pixel may have a larger aperture ratio than other sub-pixels, and thus the load applied to the blue sub-pixel may be larger than those applied to the other sub-pixels. Due to the load difference, each sub-pixel may deteriorate at a different speed, which may cause image sticking.

Embodiments disclosed in the present disclosure are to provide an electronic device for solving the aforementioned problems and the problems posed in the present disclosure.

Technical Solution

An electronic device according to an embodiment of the present disclosure may include a display panel in which at least one pixel is disposed, a converter applying a first voltage to the pixel to cause the pixel to emit light, a gamma circuit including a resistor string to which a plurality of resistors are connected and applying a second voltage to the converter, a logic circuit changing a point to which the resistor string and the converter are connected, and a processor electrically connected to the logic circuit, wherein the processor may detect whether or not deterioration occurs in the pixel, if it is determined that deterioration occurs in the pixel as a result of the detection, transmit, to the logic circuit, an instruction to compensate for the deterioration, and adjust a magnitude of the second voltage by causing the logic circuit to change the point to which the resistor string and the converter are connected based on the instruction.

In addition, an electronic device according to an embodiment of the present disclosure may include a display panel including a first region where deterioration occurs and a second region where deterioration does not occur, a display driver integrated circuit (DDI) including a first resistor circuit connected with the first region via a first electrical path and a second resistor circuit connected with the second region via a second electrical region, and a processor electrically connected with the display driver integrated circuit and configured to increase a magnitude of a current flowing in the first region by changing the first electrical path.

In addition, an electronic device according to an embodiment of the present disclosure may include a display including one or more pixels, a memory storing first grayscale data for driving the one or more pixels, and a display driver integrated circuit including one or more grayscale circuits for supplying a grayscale voltage to the one or more pixels based on the first grayscale data, wherein the display driver integrated circuit may be configured to identify information regarding at least one pixel deteriorated among the one or more pixels, determine second grayscale data obtained by changing a specified grayscale value of the first grayscale data as grayscale data corresponding to the at least one pixel, at least based on the information regarding the at least one pixel, change a specified grayscale voltage of the at least one pixel using at least one grayscale circuit corresponding to the at least one pixel among the one or more grayscale circuits, at least based on the second grayscale data, and display a specified content through the display, in a state where the specified grayscale voltage of the at least one pixel is changed.

Advantageous Effects

According to the embodiments disclosed in the present disclosure, deterioration occurring in the display may be compensated for.

Besides, various effects may be provided that are directly or indirectly identified through the present disclosure.

MODE FOR CARRYING OUT THE INVENTION

Figure 1:
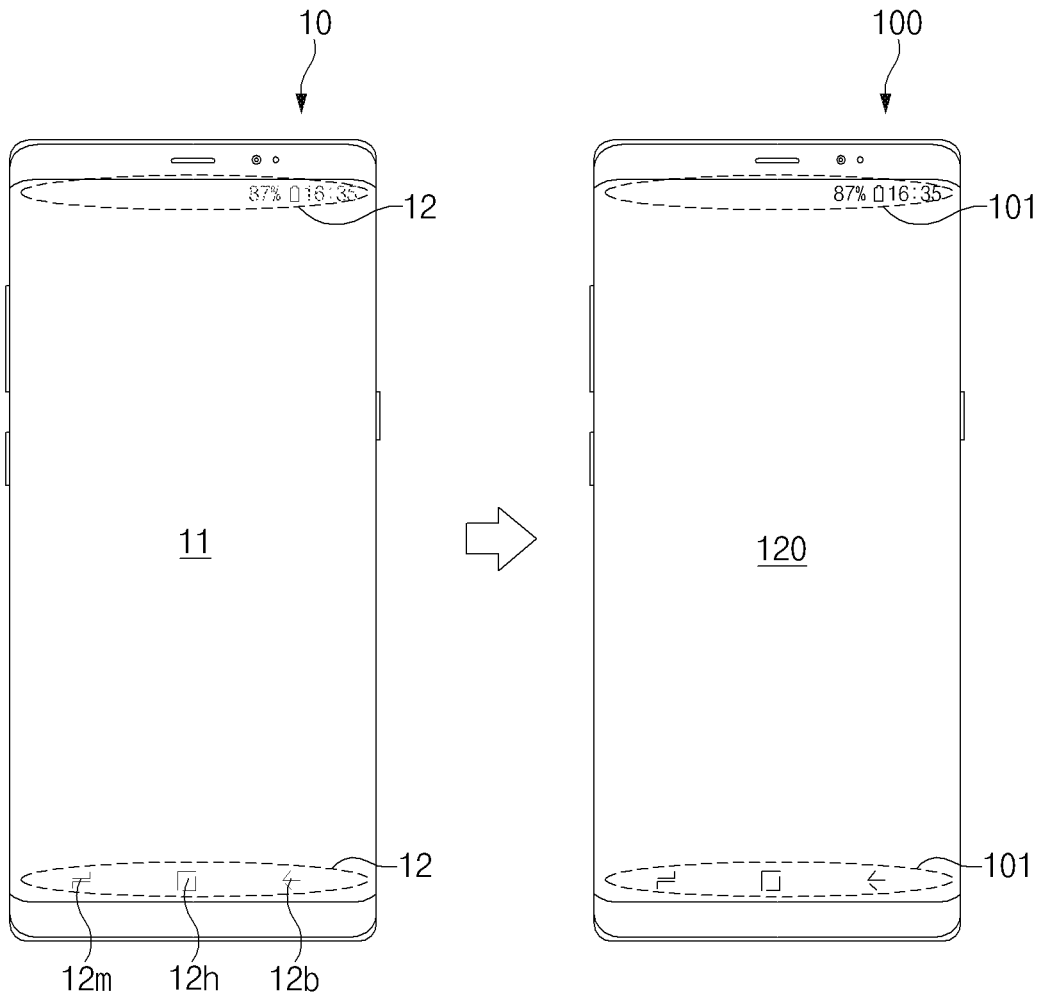
FIG. 1 illustrates an electronic device according to a comparative example and an electronic device according to an embodiment.

FIG. 1 illustrates an electronic device according to a comparative example and an electronic device according to an embodiment.

Referring to FIG. 1, even if image sticking 12 occurs on a display 11, an electronic device 10 according to the comparative example may not compensate for the image sticking. For example, the degrees of deterioration of a red sub-pixel, a green sub-pixel, and a blue sub-pixel included in the display 11 may be different. Since the degrees of deterioration are different for each sub-pixel, even if the electronic device 10 applies the same voltage to each sub-pixel, each sub-pixel may emit light with different brightness. Due to the difference in brightness, the image sticking 12 may occur on the display 11. In particular, a home key 12*h*, a back key 12*b*, a menu key 12*m*, and the like are images that are output on the home screen all the time, and thus the image sticking may occur in the form of the home key 12*h*, the back key 12*b*, and the menu key 12*m* on the display 11. Since the electronic device 10 according to the comparative example may not compensate for the difference in brightness between sub-pixels, the image sticking 12 may be recognized by the eyes of a user, and accordingly, the user may feel uncomfortable.

However, an electronic device 100 according to an embodiment of the present disclosure may compensate for image sticking occurring on a display 120. For example, the electronic device 100 may increase the brightness of a region 101 by causing a current of a certain size or more to flow through the region 101 where the image sticking occurs. As the brightness of the region 101 increases, the user may not recognize the image sticking and the visibility of the display 120 may be improved.

Figure 2:
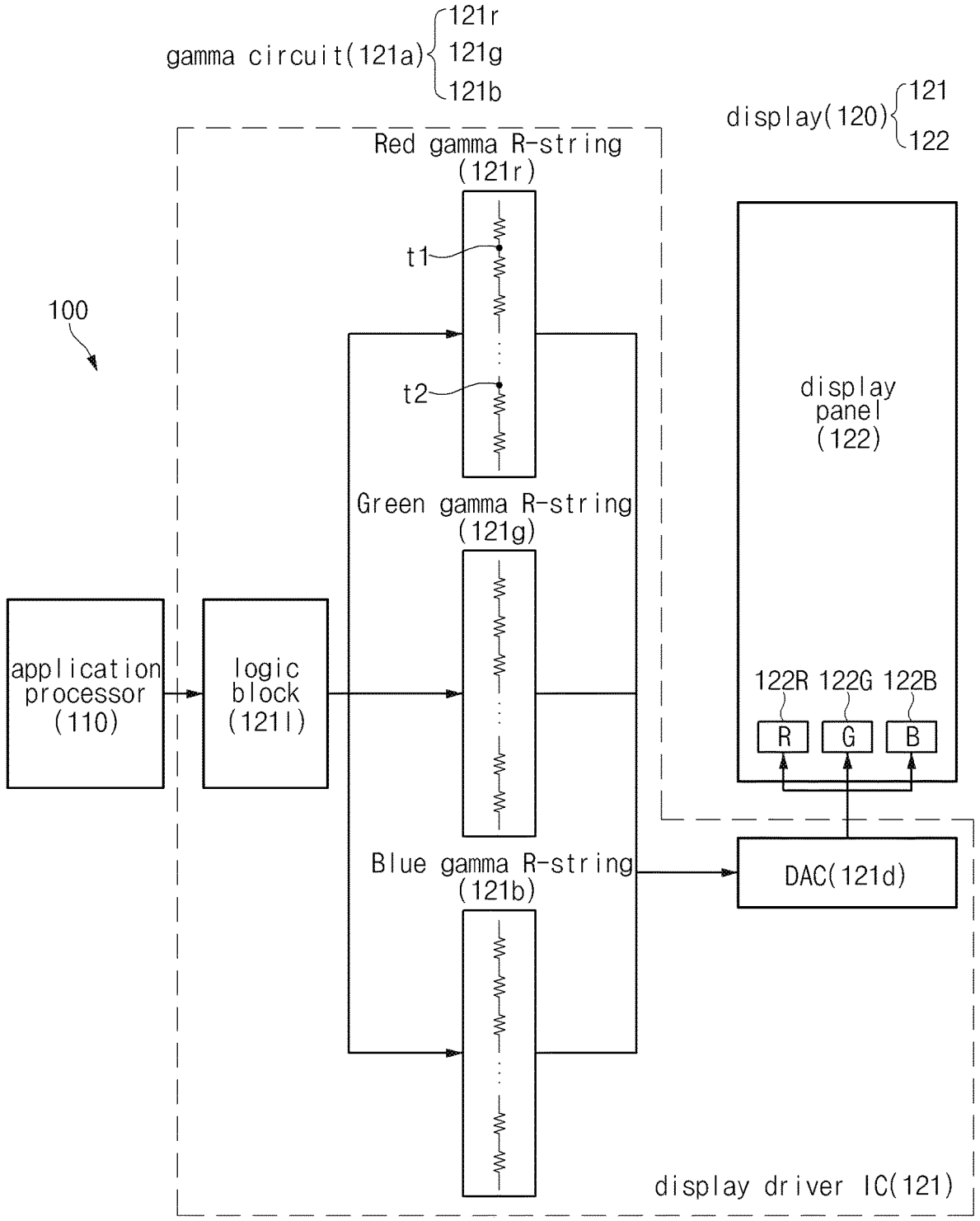
FIG. 2 illustrates a block diagram of components included in the electronic device according to an embodiment.

FIG. 2 illustrates a block diagram of components included in the electronic device according to an embodiment. FIG. 2 illustrates a block diagram of components included in the electronic device illustrated in FIG. 1.

Referring to FIG. 2, the electronic device 100 may include a processor 110 and a display 120.

The processor 110 may determine whether or not deterioration occurs in at least a portion of the display 120. For example, the processor 110 may determine whether or not deterioration occurs based on the brightness of the display 120, the temperature of the display 120, the usage time of the electronic device 100, and so on. If it is determined that deterioration occurs in at least a portion of the display 120, the processor 110 may transmit, to the display 120, an instruction to compensate for the deterioration.

In another embodiment, the processor 110 may determine whether or not deterioration occurs in sub-pixels 122R, 122G, and 122B based on the difference between the current values stored in a memory (not illustrated) and the current values flowing in the sub-pixels 122R, 122G, and 122B. For example, the processor 110 may measure current values flowing in the sub-pixels 122R, 122G, and 122B in response to a user input. If the difference between current values (e.g., first current value) stored in the memory and the current values (e.g., second current value) flowing in the sub-pixels 122R, 122G, and 122B is large, the processor 110 may determine that deterioration occurs in the sub-pixels 122R, 122G, and 122B. In contrast, if the difference between the current values stored in the memory and the current values flowing in the sub-pixels 122R, 122G, and 122B is small, the processor 110 may determine that deterioration does not occur in sub-pixels 122R, 122G, and 122B. If it is determined that deterioration occurs in the sub-pixels 122R, 122G, and 122B, the processor 110 may transmit, to the display 120, an instruction to compensate for the deterioration. In the embodiment described above, the current values stored in the memory may mean initial current values flowing in the sub-pixels 122R, 122G, and 122B.

The display 120 may include a display driver integrated circuit (DDI) and a display panel 122.

The display driver integrated circuit 121 may include a logic block 1211, a gamma circuit 121*a* (or a grayscale circuit), and a converter (digital-analog convert; DAC) 121*d*. The gamma circuit 121*a* may include a first resistor string 121*r*, a second resistor string 121*g*, and a third resistor string 121*b*. Each resistor string may mean a series of string where a plurality of resistors are connected. In the present disclosure, the first resistor string 121*r*, the second resistor string 121*g*, and the third resistor string 121*b* may be referred to as a red gamma R-string, a green gamma R-string, and a blue gamma R-string, respectively.

The logic block 1211 may receive an instruction to compensate for the deterioration from the processor 110 and store the received instruction. In addition, the logic block 1211 may adjust a grayscale voltage output from the gamma circuit 121*a* based on the instruction. For example, the logic block 1211 may adjust the grayscale voltage output from the gamma circuit 121*a* by adjusting tap points (e.g., t1 and t2) in the resistor string. In the present disclosure, the tap point may mean a position or a point to which the converter 121*d* is connected in the resistor string. In the present disclosure, the logic block may be referred to as a logic circuit.

The gamma circuit 121*a* may apply the grayscale voltage to the converter 121*d*. The grayscale voltage may mean a voltage for correcting the sensitivity of the eyes of the user. For example, even if the brightness of the light emitted from the sub-pixel changes linearly, the user may feel the change in brightness of the non-linearly. The grayscale voltage may mean a voltage for correcting the above-described nonlinear characteristics.

The converter 121*d* may convert image data into a data voltage based on the grayscale voltage received from the gamma circuit 121*a*. The image data may mean an image, content, and the like, output through the display panel 122. The data voltage is a voltage applied to the sub-pixels, and may charge a capacitive element (e.g., a capacitor) included in the sub-pixels. In the present disclosure, the converter 121*d* may be referred to as a digital-analog converter (DAC).

The sub-pixels 122R, 122G, and 122B may be mounted on the display panel 122. For example, the red sub-pixel 122R, the green sub-pixel 122G, and the blue sub-pixel 122B may be repeatedly disposed on the display panel 122. The electronic device 100 may output various images, contents, and the like, by causing the sub-pixels 122R, 122G, and 122B to emit light.

According to an embodiment, if deterioration occurs in the sub-pixels 122R, 122G, and 122B, the processor 110 may compensate for the deterioration.

First, if deterioration occurs in the red sub-pixel 122R, the processor 110 may transmit, to the logic block 1211, an instruction to compensate for the deterioration. The logic block 1211 may change a tap point in the first resistor string 121*r*. For example, the logic block 1211 may change the tap point from the first point t1 to the second point t2. If the tap point is changed from the first point t1 to the second point t2, the changed red gamma voltage may be output. In other words, if the first point t1 is the tap point, a red gamma voltage having a first grayscale value (e.g., 255 grayscales) may be output to the converter 121*d*; however, if the second point t2 is a tap point, a red gamma voltage having a second grayscale value (e.g., 260 grayscales) may be output to the converter 121*d*.

The changed red gamma voltage may be applied to the converter 121*d*, and the converter 121*d* may convert image data into a data voltage based on the changed red gamma voltage. In general, since the grayscale value of the red gamma voltage after changing is greater than the grayscale value of the red gamma voltage before changing, the magnitude of the current flowing in the red sub-pixel 122R may increase. As the magnitude of the current flowing in the red sub-pixel 122R increases, the brightness of the red sub-pixel 122R may become bright, and accordingly, the electronic device 100 may compensate for the decrease in brightness due to deterioration of the red sub-pixel 122R.

According to an embodiment, the description of the red sub-pixel 122R may also be applied to the green sub-pixel 122G and the blue sub-pixel 122B. For example, the logic block 1211 may increase the grayscale values of the green gamma voltage and the blue gamma voltage by changing the tap points of the second resistor string 121*g* and the third resistor string 121*b*. Accordingly, the brightness of the green sub-pixel 122G and the blue sub-pixel 122B may be increased, and the electronic device 100 may compensate for the decrease in brightness due to the deterioration of the green sub-pixel 122G and the blue sub-pixel 122B.

Meanwhile, the embodiment illustrated in FIG. 2 is merely an embodiment, and the embodiments of the present disclosure are not limited to that illustrated in FIG. 2. For example, structures of the first resistor string 121*r* to the third resistor string 121*b* may be different. That is, the number of resistors included in each of the first resistor string 121*r* to the third resistor string 121*b*, the connection relationship between the resistors, and so on may be different. Since the structures of the first resistor string 121*r* to the third resistor string 121*b* are different, the grayscale values of the gamma voltages output from the first resistor string 121*r* to the third resistor string 121*b* may be different. The electronic device 100 may adjust the gamma voltages output from the first resistor string 121*r* to the third resistor string 121*b* according to the degrees of deterioration of the red sub-pixel 122R, the green sub-pixel 122G, and the blue sub-pixel 122B.

In another embodiment, the electronic device 100 may change at least one tap point of the first resistor string 121*r* to the third resistor string 121*b*. For example, if deterioration occurs only in the blue sub-pixel 122B, the electronic device 100 may change the tap point of the third resistor string 121*b*. In this case, a blue gamma voltage having a grayscale value increased may be output through the third resistor string 121*b*, and the brightness of the blue sub-pixel 122B may be increased.

In the present disclosure, components having the same reference numerals as the electronic device 100 illustrated in FIG. 1 and FIG. 2 may have the same contents described in FIG. 1 and FIG. 2.

Figure 3:
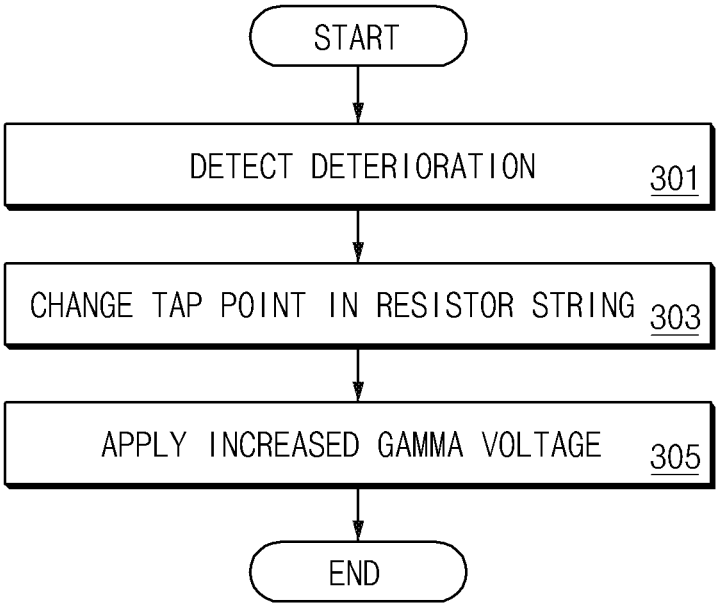
FIG. 3 illustrates an operation flowchart of the electronic device according to an embodiment.

FIG. 3 illustrates an operation flowchart of the electronic device according to an embodiment. FIG. 3 illustrates an operation flowchart of the electronic device 100 illustrated in FIG. 1.

Referring to FIG. 3, in operation 301, the electronic device (e.g., processor 110) may detect whether or not deterioration is detected in at least a portion of the display 120. For example, the processor 110 may determine whether or not deterioration occurs based on the brightness of the display 120, the temperature of the display 120, the usage time of the electronic device 100, and so on.

In another embodiment, the electronic device 100 (e.g., processor 110) may determine whether or not deterioration occurs in sub-pixels 122R, 122G, and 122B based on the difference between the current values stored in a memory (not illustrated) and the current values flowing in the sub-pixels 122R, 122G, and 122B. For example, the electronic device 100 may measure current values flowing in the sub-pixels 122R, 122G, and 122B in response to a user input. The electronic device 100 may determine that deterioration occurs in the sub-pixels 122R, 122G, and 122B if the difference between the current values (e.g., first current value) stored in the memory and the current values (e.g., second current value) flowing in the sub-pixels 122R, 122G, and 122B is large. In contrast, the electronic device 100 may determine that deterioration does not occur in sub-pixels 122R, 122G, and 122B if the difference between the current values stored in the memory and the current values flowing in the sub-pixels 122R, 122G, and 122B is small. If it is determined that deterioration occurs in the sub-pixels 122R, 122G, and 122B, the electronic device 100 may transmit, to the display 120, an instruction to compensate for the deterioration.

According to an embodiment, a region of the display 120 in which the same image is continuously output (e.g., a region in which a home key and the like are output) may have a higher possibility of deterioration than other regions. The processor 110 may identify whether or not deterioration occurs in the region where the same image is continuously output more frequently than in the other regions.

According to an embodiment, the size of the region in which the processor 110 is able to detect deterioration may vary. For example, the processor 110 may determine whether or not deterioration occurs for each pixel or sub-pixel. In another embodiment, the processor 110 may determine whether or not deterioration occurs in a region specified by the user. If it is determined that deterioration occurs in at least a portion of the display 120, the processor 110 may transmit, to the display 120, an instruction to compensate for the deterioration.

In operation 303, the electronic device 100 (e.g., logic block 1211) may change a tap point in the resistor string. For example, the processor 110 may change the tap point in the first resistor string 121*r*. If the tap point is changed, the changed red gamma voltage may be output to the converter 121*d*. More specifically, a red gamma voltage having a first grayscale value (e.g., 255 grayscales) may be output to the converter 121*d* before the tap point is changed; on the other hand, a red gamma voltage having a second grayscale value (e.g., 260 grayscales) may be output to the converter 121*d* after the tap point is changed.

In operation 305, the electronic device 100 (e.g., gamma circuit 121*a*) may apply the changed (or increased) gamma voltage to the converter 121*d*. The converter 121*d* may convert image data into a data voltage based on the changed gamma voltage. In general, since the grayscale value of the changed gamma voltage is greater than the grayscale value of the gamma voltage before the change, the magnitude of the current flowing in the sub-pixel may increase. As the magnitude of the current flowing in the sub-pixel increases, the brightness of the sub-pixel may be increased, and a decrease in brightness due to deterioration of the sub-pixel may be compensated.

Figure 4:
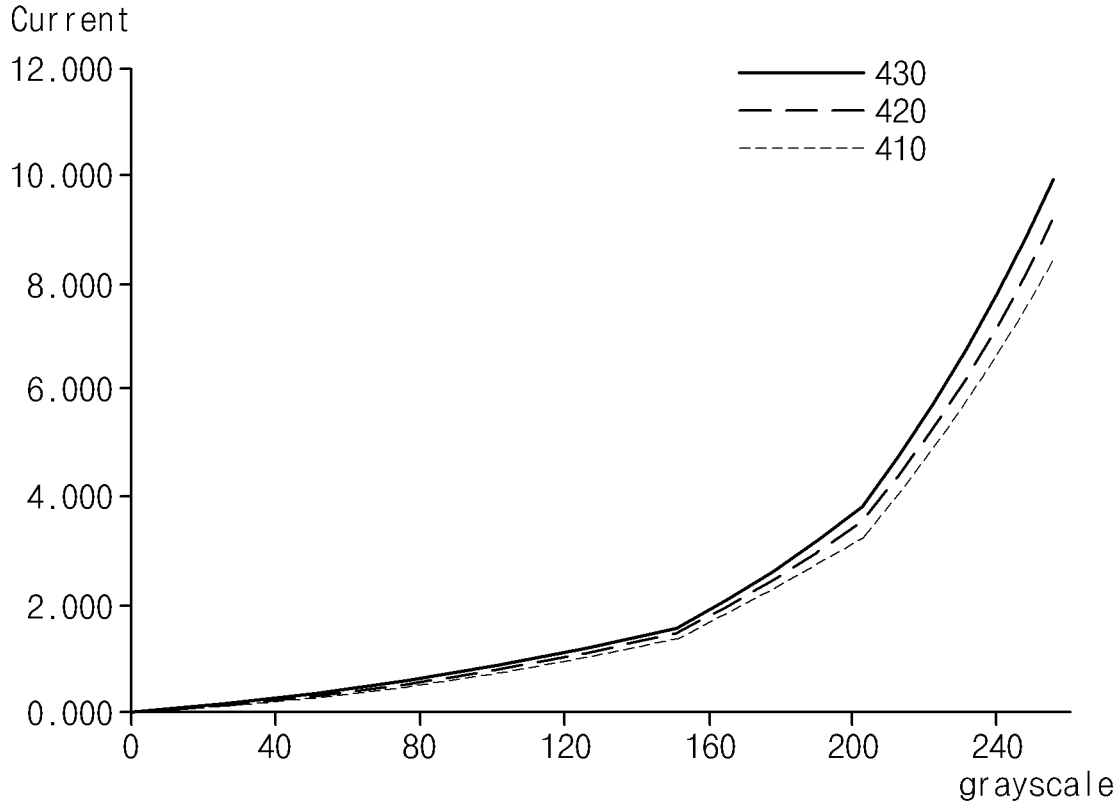
FIG. 4 illustrates magnitudes of currents flowing in sub-pixels according to an embodiment.

FIG. 4 illustrates magnitudes of currents flowing in sub-pixels according to an embodiment. The graphs 420 and 430 illustrated in FIG. 4 represent the magnitude of the current flowing in any one of the red sub-pixel 122R, the green sub-pixel 122G, and the blue sub-pixel 122B illustrated in FIG. 2.

Referring to FIG. 4, the graph 410 represents the current flowing in a sub-pixel according to a comparative example. Referring to the graph 410, for the sub-pixel according to the comparative example, since a gamma voltage of a certain grayscale (e.g., 255 grayscales) or more is not applied, the magnitude of the current flowing in the sub-pixel may also be limited.

Graph 420 and graph 430 represent currents flowing in the sub-pixel (e.g., the red sub-pixel 122R) according to an embodiment of the present disclosure. For example, graph 420 represents the current flowing in the sub-pixel when the gamma voltage having a maximum of 257 grayscales is applied. The graph 430 represents the current flowing in the sub-pixel when a gamma voltage having a maximum of 260 grayscales is applied.

Referring to the graph 420 and the graph 430, since the maximum grayscale value of the gamma voltage applied to the sub-pixel is equal to or greater than a certain level (e.g., 255 grayscales), the magnitude of the current flowing in the sub-pixel may also increase to or over a certain level. That is, according to an embodiment of the present disclosure, by changing the tap point in the resistor string, a gamma voltage having a large grayscale value may be applied to the sub-pixel, and accordingly, the magnitude of the current flowing in the sub-pixel may increase. As the magnitude of the current increases, the brightness of the sub-pixel may also increase, and the decrease in brightness due to deterioration may be compensated.

TABLE 1

| | | | | | | |
|---|---|---|---|---|---|---|
| Grayscale value | 1 | 7 | 11 | . . . | 203 | 255 |
| Magnitude of current | 0 | 0.3 | 0.8 | . . . | 3.8 | 6.5 |
| Brightness | 0 | 1 | 10 | . . . | 250 | 420 |

TABLE 2

| | | | | | | |
|---|---|---|---|---|---|---|
| Grayscale value | 1 | 7 | 11 | . . . | 203 | 260 |
| Magnitude of current | 0 | 0.5 | 1.1 | . . . | 4.2 | 8.8 |
| Brightness | 0 | 1.2 | 11 | . . . | 255 | 440 |

Table 1 shows the grayscale value, the magnitude of the current, and the brightness of the gamma voltage applied to the sub-pixel according to the comparative example. Table 2 shows the grayscale value, the magnitude of the current, and the brightness of the gamma voltage applied to the sub-pixel (e.g., red sub-pixel 122R) according to an embodiment of the present disclosure.

Referring to Table 1 and Table 2, a gamma voltage having a maximum of 255 grayscales may be applied to the sub-pixel according to the comparative example, but a gamma voltage having a maximum of 260 grayscales may be applied to the sub-pixel according to an embodiment of the present disclosure. Accordingly, the current flowing in the sub-pixel according to an embodiment of the present disclosure may be larger than that flowing in the sub-pixel according to the comparative example. Further, the brightness of the sub-pixel according to an embodiment of the present disclosure may be brighter than the brightness of the sub-pixel according to the comparative example. Since the brightness of the sub-pixel increases, the electronic device 100 may compensate for the decrease in brightness due to the deterioration of the sub-pixel.

Figure 5:
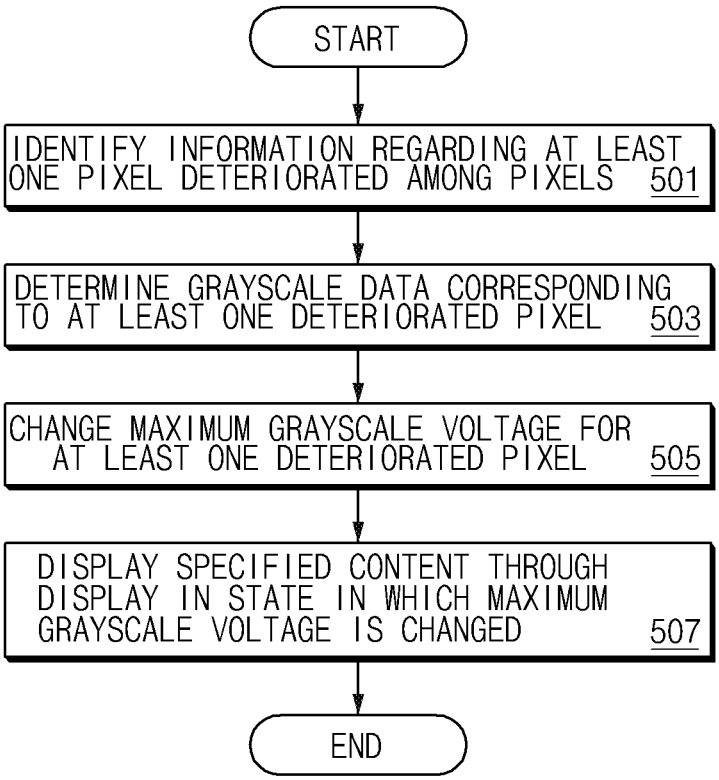
FIG. 5 illustrates an operation flowchart of an electronic device according to another embodiment.

FIG. 5 illustrates an operation flowchart of an electronic device according to another embodiment.

Referring to FIG. 5, in operation 501, the electronic device 100 (e.g., the display driver integrated circuit 121) may identify information regarding at least one pixel deteriorated among pixels (e.g., sub-pixels 122R, 122G, and 122B of FIG. 2). For example, the processor 110 may determine whether or not deterioration occurs based on the brightness of the display 120, the temperature of the display 120, the usage time of the electronic device 100, the current flowing in the pixel, and so on. The display driver integrated circuit 121 may receive information regarding the at least one deteriorated pixel from the processor 110 and identify at least one deteriorated pixel based on the information.

In operation 503, the electronic device 100 (e.g., the display driver integrated circuit 121) may determine grayscale data corresponding to at least one deteriorated pixel. For example, the memory may store first grayscale data for driving pixels. The display driver integrated circuit 121 may change the specified grayscale value of the first grayscale data to second grayscale data based on the information regarding the at least one deteriorated pixel. The display driver integrated circuit 121 may determine the second grayscale data as grayscale data corresponding to the at least one deteriorated pixel.

In operation 505, the electronic device 100 (e.g., the display driver integrated circuit 121) may change the specified grayscale voltage for the at least one deteriorated pixel using the grayscale circuits (or the gamma circuit 121*a* of FIG. 2). For example, the electronic device 100 may change the specified grayscale voltage by adjusting the tap points (e.g., t1 and t2 in FIG. 2) in a resistor string (e.g., the first resistor string 121*r* of FIG. 2) included in the grayscale circuits.

In operation 507, the electronic device 100 (e.g., the display driver integrated circuit 121) may display the specified content through the display 120 in a state in which the specified grayscale voltage is changed. Since the specified content is displayed in a state in which the specified grayscale voltage is changed, the user may not recognize the image sticking and the visibility of the display 120 may be improved.

An electronic device according to an embodiment of the present disclosure may include a display panel in which at least one pixel is disposed, a converter applying a first voltage to the pixel to cause the pixel to emit light, a gamma circuit including a resistor string to which a plurality of resistors are connected and applying a second voltage to the converter, a logic circuit changing a point to which the resistor string and the converter are connected, and a processor electrically connected to the logic circuit, wherein the processor is configured to: detect whether or not deterioration occurs in the pixel; based on the determination that deterioration occurs in the pixel as a result of the detection, transmit, to the logic circuit, an instruction to compensate for the deterioration; and adjust a magnitude of the second voltage by causing the logic circuit to change the point to which the resistor string and the converter are connected based on the instruction.

The second voltage according to an embodiment of the present disclosure may correspond to a gamma voltage, and the processor is further configured to increase a grayscale value of the gamma voltage by changing the point if it is determined that deterioration occurs in the pixel.

The processor according to an embodiment of the present disclosure is further configured to increase a magnitude of a current flowing in the pixel by changing the point if it is determined that deterioration occurs in the pixel.

The point to which the resistor string and the converter are connected according to an embodiment of the present disclosure may include at least one of the points to which the plurality of resistors are connected.

The pixel according to an embodiment of the present disclosure may include a first sub-pixel and a second sub-pixel, and the gamma circuit may include a first resistor string corresponding to the first sub-pixel and a second resistor string corresponding to the second sub-pixel.

The processor according to an embodiment of the present disclosure is further configured to change a first point to which the first resistor string and the converter are connected and a second point to which the second resistor string and the converter are connected if it is determined that deterioration occurs in the pixel.

The first resistor string and the second resistor string according to an embodiment of the present disclosure may have different structures.

The pixel according to an embodiment of the present disclosure may further include a third sub-pixel, and the gamma circuit may further include a third resistor string corresponding to the third sub-pixel.

The processor according to an embodiment of the present disclosure is further configured to change a third point to which the third resistor string and the converter are connected if it is determined that deterioration occurs in the pixel.

The processor according to an embodiment of the present disclosure is further configured to detect whether or not deterioration occurs in the pixel based on at least one of a temperature of the pixel, a driving time of the pixel, and a brightness of the pixel.

The converter according to an embodiment of the present disclosure may convert image data generated in the processor into the first voltage based on the second voltage.

The logic circuit according to an embodiment of the present disclosure may store an instruction to compensate for the deterioration.

An electronic device according to an embodiment of the present disclosure may include a display panel including a first region where deterioration occurs and a second region where deterioration does not occur, a display driver integrated circuit (DDI) including a first resistor circuit connected with the first region via a first electrical path and a second resistor circuit connected with the second region via a second electrical region, and a processor electrically connected with the display driver integrated circuit and configured to increase a magnitude of a current flowing in the first region by changing the first electrical path.

The display driver integrated circuit according to an embodiment of the present disclosure may further include a converter disposed on the first electrical path.

The processor according to an embodiment of the present disclosure may be configured to increase a magnitude of a current flowing in the first region by changing a position to which the converter is connected within the first resistor circuit.

The processor according to an embodiment of the present disclosure may be configured to increase a magnitude of a voltage applied to the converter by changing a position to which the converter is connected within the first resistor circuit.

The voltage according to an embodiment of the present disclosure may correspond to a gamma voltage and the processor may increase a grayscale value of the gamma voltage by changing the position to which the converter is connected within the first resistor circuit.

The processor according to an embodiment of the present disclosure may be configured to, if deterioration occurs in the second region, increase a magnitude of a current flowing in the second region by changing the second electrical path.

The processor according to an embodiment of the present disclosure may be configured to maintain the second electrical path.

The processor according to an embodiment of the present disclosure may detect whether or not the deterioration occurs in the first region based on at least one of a temperature of the first region, a driving time of the first region, and a brightness of the first region.

An electronic device according to an embodiment of the present disclosure may include a display including one or more pixels, a memory storing first grayscale data for driving the one or more pixels, and a display driver integrated circuit including one or more grayscale circuits for supplying a grayscale voltage to the one or more pixels based on the first grayscale data, wherein the display driver integrated circuit may be configured to identify information regarding at least one pixel deteriorated among the one or more pixels, determine second grayscale data obtained by changing a specified grayscale value of the first grayscale data as grayscale data corresponding to the at least one pixel, at least based on the information regarding the at least one pixel, change a specified grayscale voltage of the at least one pixel using at least one grayscale circuit corresponding to the at least one pixel among the one or more grayscale circuits, at least based on the second grayscale data, and display a specified content through the display, in a state where the specified grayscale voltage of the at least one pixel is changed.

The display driver integrated circuit according to an embodiment of the present disclosure may receive information regarding the at least one pixel deteriorated from the processor.

The display driver integrated circuit according to an embodiment of the present disclosure may determine the second grayscale data obtained by changing the specified grayscale value to a larger grayscale value, as grayscale data corresponding to the at least one pixel.

Figure 6:
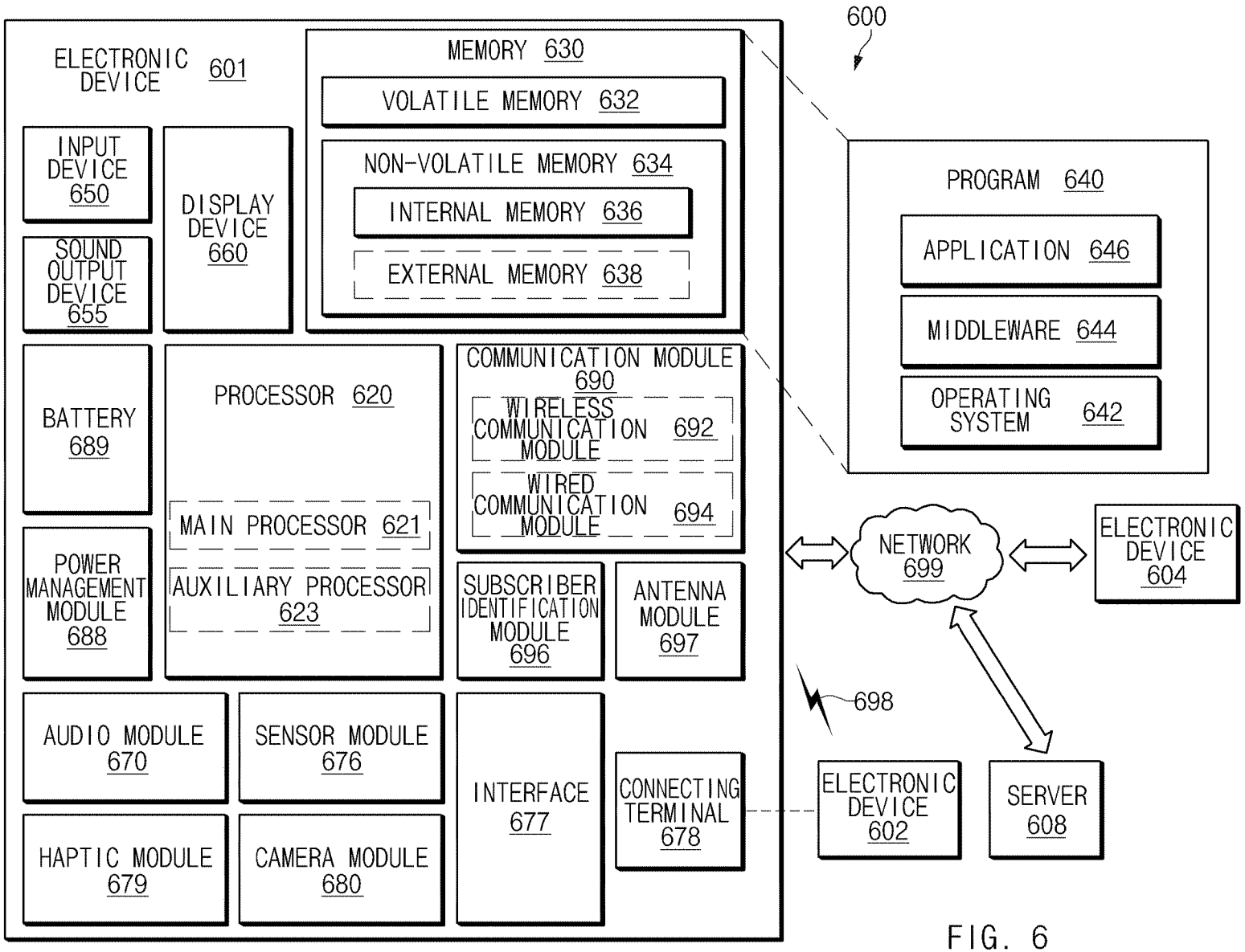
FIG. 6 is a block diagram illustrating an electronic device in a network environment according to various embodiments.

FIG. 6 is a block diagram illustrating an electronic device 601 in a network environment 600 according to various embodiments.

Referring to FIG. 6, the electronic device 601 in the network environment 600 may communicate with an electronic device 602 via a first network 698 (e.g., a short-range wireless communication network), or an electronic device 604 or a server 608 via a second network 699 (e.g., a long-range wireless communication network). According to an embodiment, the electronic device 601 may communicate with the electronic device 604 via the server 608. According to an embodiment, the electronic device 601 may include a processor 620, memory 630, an input device 650, a sound output device 655, a display device 660, an audio module 670, a sensor module 676, an interface 677, a haptic module 679, a camera module 680, a power management module 688, a battery 689, a communication module 690, a subscriber identification module (SIM) 696, or an antenna module 697. In some embodiments, at least one (e.g., the display device 660 or the camera module 680) of the components may be omitted from the electronic device 601, or one or more other components may be added in the electronic device 601. In some embodiments, some of the components may be implemented as single integrated circuitry. For example, the sensor module 676 (e.g., a fingerprint sensor, an iris sensor, or an illuminance sensor) may be implemented as embedded in the display device 660 (e.g., a display).

The processor 620 may execute, for example, software (e.g., a program 640) to control at least one other component (e.g., a hardware or software component) of the electronic device 601 coupled with the processor 620, and may perform various data processing or computation. According to one embodiment, as at least part of the data processing or computation, the processor 620 may load a command or data received from another component (e.g., the sensor module 676 or the communication module 690) in volatile memory 632, process the command or the data stored in the volatile memory 632, and store resulting data in non-volatile memory 634. According to an embodiment, the processor 620 may include a main processor 621 (e.g., a central processing unit (CPU) or an application processor (AP)), and an auxiliary processor 623 (e.g., a graphics processing unit (GPU), an image signal processor (ISP), a sensor hub processor, or a communication processor (CP)) that is operable independently from, or in conjunction with, the main processor 621. Additionally or alternatively, the auxiliary processor 623 may be adapted to consume less power than the main processor 621, or to be specific to a specified function. The auxiliary processor 623 may be implemented as separate from, or as part of the main processor 621.

The auxiliary processor 623 may control at least some of functions or states related to at least one component (e.g., the display device 660, the sensor module 676, or the communication module 690) among the components of the electronic device 601, instead of the main processor 621 while the main processor 621 is in an inactive (e.g., sleep) state, or together with the main processor 621 while the main processor 621 is in an active state (e.g., executing an application). According to an embodiment, the auxiliary processor 623 (e.g., an image signal processor or a communication processor) may be implemented as part of another component (e.g., the camera module 680 or the communication module 690) functionally related to the auxiliary processor 623.

The memory 630 may store various data used by at least one component (e.g., the processor 620 or the sensor module 676) of the electronic device 601. The various data may include, for example, software (e.g., the program 640) and input data or output data for a command related thereto. The memory 630 may include the volatile memory 632 or the non-volatile memory 634.

The program 640 may be stored in the memory 630 as software, and may include, for example, an operating system (OS) 642, middleware 644, or an application 646.

The input device 650 may receive a command or data to be used by other component (e.g., the processor 620) of the electronic device 601, from the outside (e.g., a user) of the electronic device 601. The input device 650 may include, for example, a microphone, a mouse, or a keyboard.

The sound output device 655 may output sound signals to the outside of the electronic device 601. The sound output device 655 may include, for example, a speaker or a receiver. The speaker may be used for general purposes, such as playing multimedia or playing record, and the receiver may be used for an incoming call. According to an embodiment, the receiver may be implemented as separate from, or as part of the speaker.

The display device 660 may visually provide information to the outside (e.g., a user) of the electronic device 601. The display device 660 may include, for example, a display, a hologram device, or a projector and control circuitry to control a corresponding one of the display, hologram device, and projector. According to an embodiment, the display device 660 may include touch circuitry adapted to detect a touch, or sensor circuitry (e.g., a pressure sensor) adapted to measure the intensity of force incurred by the touch.

The audio module 670 may convert a sound into an electrical signal and vice versa. According to an embodiment, the audio module 670 may obtain the sound via the input device 650, or output the sound via the sound output device 655 or a headphone of an external electronic device (e.g., an electronic device 602) directly (e.g., wiredly) or wirelessly coupled with the electronic device 601.

The sensor module 676 may detect an operational state (e.g., power or temperature) of the electronic device 601 or an environmental state (e.g., a state of a user) external to the electronic device 601, and then generate an electrical signal or data value corresponding to the detected state. According to an embodiment, the sensor module 676 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 677 may support one or more specified protocols to be used for the electronic device 601 to be coupled with the external electronic device (e.g., the electronic device 602) directly (e.g., wiredly) or wirelessly. According to an embodiment, the interface 677 may include, for example, a high definition multimedia interface (HDMI), a universal serial bus (USB) interface, a secure digital (SD) card interface, or an audio interface.

A connecting terminal 678 may include a connector via which the electronic device 601 may be physically connected with the external electronic device (e.g., the electronic device 602). According to an embodiment, the connecting terminal 678 may include, for example, a HDMI connector, a USB connector, a SD card connector, or an audio connector (e.g., a headphone connector).

The haptic module 679 may convert an electrical signal into a mechanical stimulus (e.g., a vibration or a movement) or electrical stimulus which may be recognized by a user via his tactile sensation or kinesthetic sensation. According to an embodiment, the haptic module 679 may include, for example, a motor, a piezoelectric element, or an electric stimulator.

The camera module 680 may capture a still image or moving images. According to an embodiment, the camera module 680 may include one or more lenses, image sensors, image signal processors, or flashes.

The power management module 688 may manage power supplied to the electronic device 601. According to one embodiment, the power management module 688 may be implemented as at least part of, for example, a power management integrated circuit (PMIC).

The battery 689 may supply power to at least one component of the electronic device 601. According to an embodiment, the battery 689 may include, for example, a primary cell which is not rechargeable, a secondary cell which is rechargeable, or a fuel cell.

The communication module 690 may support establishing a direct (e.g., wired) communication channel or a wireless communication channel between the electronic device 601 and the external electronic device (e.g., the electronic device 602, the electronic device 604, or the server 608) and performing communication via the established communication channel. The communication module 690 may include one or more communication processors that are operable independently from the processor 620 (e.g., the application processor (AP)) and supports a direct (e.g., wired) communication or a wireless communication. According to an embodiment, the communication module 690 may include a wireless communication module 692 (e.g., a cellular communication module, a short-range wireless communication module, or a global navigation satellite system (GNSS) communication module) or a wired communication module 694 (e.g., a local area network (LAN) communication module or a power line communication (PLC) module). A corresponding one of these communication modules may communicate with the external electronic device via the first network 698 (e.g., a short-range communication network, such as Bluetooth™, wireless-fidelity (Wi-Fi) direct, or infrared data association (IrDA)) or the second network 699 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 692 may identify and authenticate the electronic device 601 in a communication network, such as the first network 698 or the second network 699, using subscriber information (e.g., international mobile subscriber identity (IMSI)) stored in the subscriber identification module 696.

The antenna module 697 may transmit or receive a signal or power to or from the outside (e.g., the external electronic device) of the electronic device 601. According to an embodiment, the antenna module 697 may include one or more antennas, and, therefrom, at least one antenna appropriate for a communication scheme used in the communication network, such as the first network 698 or the second network 699, may be selected, for example, by the communication module 690 (e.g., the wireless communication module 692). The signal or the power may then be transmitted or received between the communication module 690 and the external electronic device via the selected at least one antenna.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 601 and the external electronic device 604 via the server 608 coupled with the second network 699. Each of the electronic devices 602 and 604 may be a device of a same type as, or a different type, from the electronic device 601. According to an embodiment, all or some of operations to be executed at the electronic device 601 may be executed at one or more of the external electronic devices 602, 604, or 608. For example, if the electronic device 601 should perform a function or a service automatically, or in response to a request from a user or another device, the electronic device 601, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 601. The electronic device 601 may provide the outcome, with or without further processing of the outcome, as at least part of a reply to the request. To that end, a cloud computing, distributed computing, or client-server computing technology may be used, for example.

Figure 7:
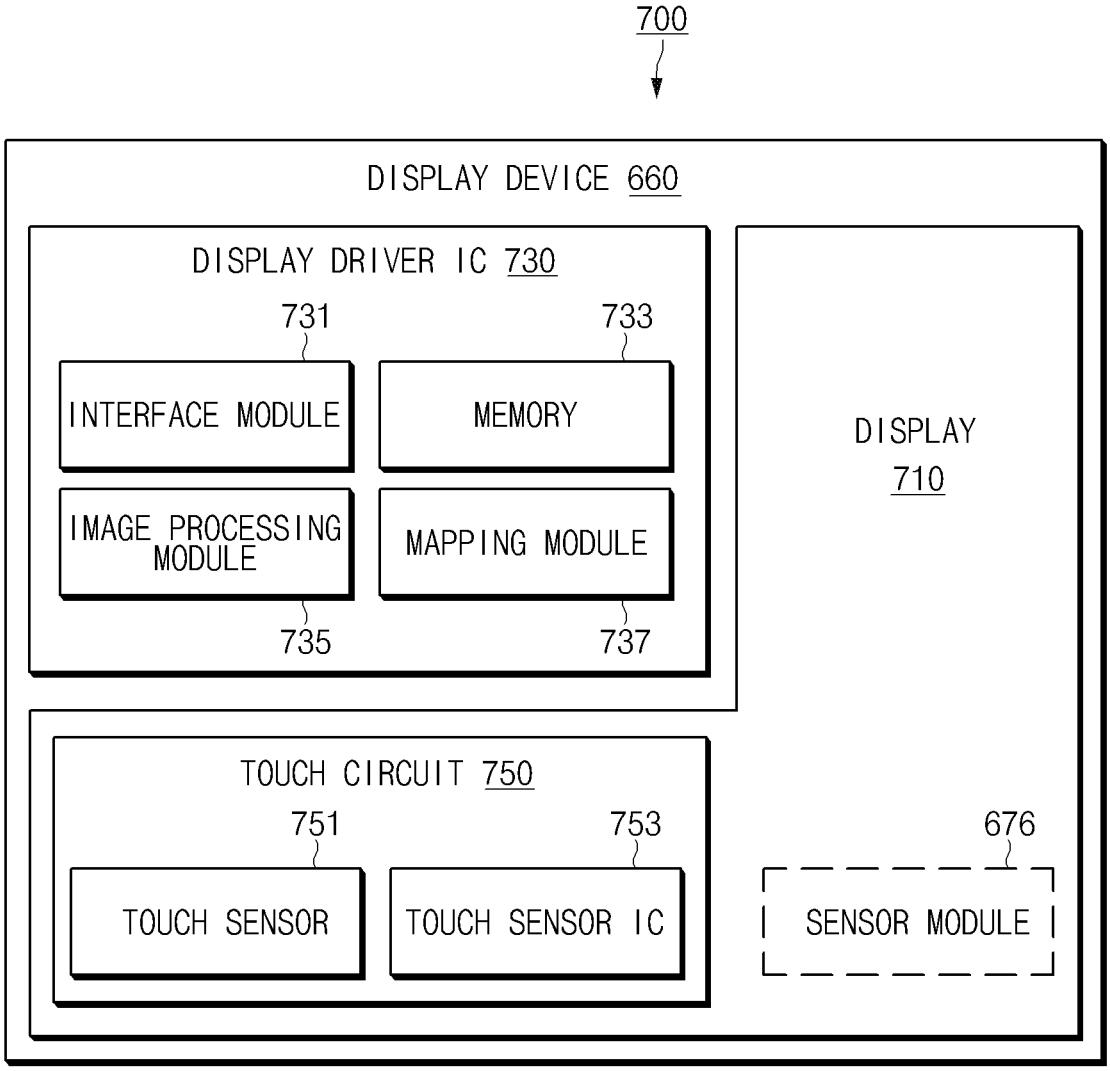
FIG. 7 is a block diagram illustrating the display device according to various embodiments.

FIG. 7 is a block diagram 700 illustrating the display device 660 according to various embodiments.

Referring to FIG. 7, the display device 660 may include a display 710 and a display driver integrated circuit (DDI) 730 to control the display 710. The DDI 730 may include an interface module 731, memory 733 (e.g., buffer memory), an image processing module 735, or a mapping module 737. The DDI 730 may receive image information that contains image data or an image control signal corresponding to a command to control the image data from another component of the electronic device 601 via the interface module 731. For example, according to an embodiment, the image information may be received from the processor 620 (e.g., the main processor 621 (e.g., an application processor)) or the auxiliary processor 623 (e.g., a graphics processing unit) operated independently from the function of the main processor 621. The DDI 730 may communicate, for example, with touch circuitry 650 or the sensor module 676 via the interface module 731. The DDI 730 may also store at least part of the received image information in the memory 733, for example, on a frame by frame basis. The image processing module 735 may perform pre-processing or post-processing (e.g., adjustment of resolution, brightness, or size) with respect to at least part of the image data. According to an embodiment, the pre-processing or post-processing may be performed, for example, based at least in part on one or more characteristics of the image data or one or more characteristics of the display 710. The mapping module 737 may generate a voltage value or a current value corresponding to the image data pre-processed or post-processed by the image processing module 735. According to an embodiment, the generating of the voltage value or current value may be performed, for example, based at least in part on one or more attributes of the pixels (e.g., an array, such as an RGB stripe or a pentile structure, of the pixels, or the size of each subpixel). At least some pixels of the display 710 may be driven, for example, based at least in part on the voltage value or the current value such that visual information (e.g., a text, an image, or an icon) corresponding to the image data may be displayed via the display 710.

According to an embodiment, the display device 660 may further include the touch circuitry 750. The touch circuitry 750 may include a touch sensor 751 and a touch sensor IC 753 to control the touch sensor 751. The touch sensor IC 753 may control the touch sensor 751 to sense a touch input or a hovering input with respect to a certain position on the display 710. To achieve this, for example, the touch sensor 751 may detect (e.g., measure) a change in a signal (e.g., a voltage, a quantity of light, a resistance, or a quantity of one or more electric charges) corresponding to the certain position on the display 710. The touch circuitry 750 may provide input information (e.g., a position, an area, a pressure, or a time) indicative of the touch input or the hovering input detected via the touch sensor 751 to the processor 620. According to an embodiment, at least part (e.g., the touch sensor IC 753) of the touch circuitry 750 may be formed as part of the display 710 or the DDI 730, or as part of another component (e.g., the auxiliary processor 623) disposed outside the display device 660.

According to an embodiment, the display device 660 may further include at least one sensor (e.g., a fingerprint sensor, an iris sensor, a pressure sensor, or an illuminance sensor) of the sensor module 676 or a control circuit for the at least one sensor. In such a case, the at least one sensor or the control circuit for the at least one sensor may be embedded in one portion of a component (e.g., the display 710, the DDI 730, or the touch circuitry 650)) of the display device 660. For example, when the sensor module 676 embedded in the display device 660 includes a biometric sensor (e.g., a fingerprint sensor), the biometric sensor may obtain biometric information (e.g., a fingerprint image) corresponding to a touch input received via a portion of the display 710. As another example, when the sensor module 676 embedded in the display device 660 includes a pressure sensor, the pressure sensor may obtain pressure information corresponding to a touch input received via a partial or whole area of the display 710. According to an embodiment, the touch sensor 751 or the sensor module 676 may be disposed between pixels in a pixel layer of the display 710, or over or under the pixel layer.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 640) including one or more instructions that are stored in a storage medium (e.g., internal memory 636 or external memory 638) that is readable by a machine (e.g., the electronic device 601). For example, a processor (e.g., the processor 620) of the machine (e.g., the electronic device 601) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™, or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

The invention claimed is:

1. An electronic device comprising:

a display panel in which at least one pixel is disposed;

a converter applying a first voltage to the pixel to cause the pixel to emit light;

a gamma circuit including a resistor string to which a plurality of resistors are connected and applying a second voltage to the converter;

a logic circuit changing a point to which the resistor string and the converter are connected; and a processor electrically connected to the logic circuit, wherein the processor is configured to:

detect whether or not deterioration occurs in the pixel;

based on the determination that deterioration occurs in the pixel as a result of the detection, transmit, to the logic circuit, an instruction to compensate for the deterioration; and adjust a magnitude of the second voltage by causing the logic circuit to change the point to which the resistor string and the converter are connected based on the instruction.

2. The electronic device of claim 1, wherein the second voltage corresponds to a gamma voltage, and based on the determination that deterioration occurs in the pixel, the processor is further configured to increase a grayscale value of the gamma voltage by changing the point.

3. The electronic device of claim 1, wherein based on the determination that deterioration occurs in the pixel, the processor is further configured to increase a magnitude of a current flowing in the pixel by changing the point.

4. The electronic device of claim 1, wherein the point to which the resistor string and the converter are connected includes at least one of points to which the plurality of resistors are connected.

5. The electronic device of claim 1, wherein the pixel includes a first sub-pixel and a second sub-pixel, and wherein the gamma circuit includes a first resistor string corresponding to the first sub-pixel and a second resistor string corresponding to the second sub-pixel.

6. The electronic device of claim 5, wherein based on the determination that deterioration occurs in the pixel, the processor is further configured to change a first point to which the first resistor string and the converter are connected and a second point to which the second resistor string and the converter are connected.

7. The electronic device of claim 5, wherein the first resistor string and the second resistor string have different structures.

8. The electronic device of claim 5, wherein the pixel further includes a third sub-pixel, and wherein the gamma circuit further includes a third resistor string corresponding to the third sub-pixel.

9. The electronic device of claim 8, wherein based on the determination that deterioration occurs in the pixel, the processor is further configured to change a third point to which the third resistor string and the converter are connected.

10. The electronic device of claim 1, wherein the processor is further configured to detect whether or not deterioration occurs in the pixel based on at least one of a temperature of the pixel, a driving time of the pixel, and a brightness of the pixel.

11. The electronic device of claim 1, wherein the converter converts image data generated in the processor into the first voltage based on the second voltage.

12. The electronic device of claim 1, wherein the logic circuit stores an instruction to compensate for the deterioration.

13. An electronic device comprising:

a display panel including a first region where deterioration occurs and a second region where deterioration does not occur;

a display driver integrated circuit (DDI) including a first resistor circuit connected with the first region via a first electrical path and a second resistor circuit connected with the second region via a second electrical region; and a processor electrically connected with the display driver integrated circuit and configured to increase a magnitude of a current flowing in the first region by changing the first electrical path.

14. The electronic device of claim 13, wherein the display driver integrated circuit further includes a converter disposed on the first electrical path.

15. The electronic device of claim 14, wherein the processor is configured to further increase a magnitude of a current flowing in the first region by changing a position to which the converter is connected within the first resistor circuit.

* * * * *